US011143177B2

(12) United States Patent
Ohata

(10) Patent No.: US 11,143,177 B2
(45) Date of Patent: Oct. 12, 2021

(54) RECIPROCATING COMPRESSOR AND CONTROL METHOD THEREFOR

(71) Applicant: Hitachi Industrial Equipment Systems Co., Ltd., Tokyo (JP)

(72) Inventor: Akito Ohata, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 456 days.

(21) Appl. No.: 16/077,503

(22) PCT Filed: Dec. 7, 2016

(86) PCT No.: PCT/JP2016/086443
§ 371 (c)(1),
(2) Date: Aug. 13, 2018

(87) PCT Pub. No.: WO2018/105068
PCT Pub. Date: Jun. 14, 2018

(65) Prior Publication Data

US 2019/0055935 A1 Feb. 21, 2019

(51) Int. Cl.
*F04B 49/02* (2006.01)
*F04B 35/04* (2006.01)
(Continued)

(52) U.S. Cl.
CPC ..... *F04B 49/022* (2013.01); *F04B 35/04* (2013.01); *F04B 41/02* (2013.01); *F04B 49/02* (2013.01);
(Continued)

(58) Field of Classification Search
CPC ..... F04B 27/053; F04B 27/0536; F04B 27/0538; F04B 35/01; F04B 35/04;
(Continued)

(56) References Cited

U.S. PATENT DOCUMENTS 3,278,111 A * 10/1966 Parker ..... F25B 31/02 417/32
4,059,366 A * 11/1977 Gannaway ..... F04B 49/10 417/32
4,358,247 A * 11/1982 Suzuki ..... F04C 28/26 417/13
2009/0159576 A1* 6/2009 Sommerfeld ..... B23K 9/32 219/121.54

FOREIGN PATENT DOCUMENTS

JP 2004-124711 A 4/2004
JP 2004124711 A * 4/2004 ..... F04B 49/10
(Continued)

OTHER PUBLICATIONS

JP2004124711A_MT; Published Apr. 22, 2004; English Translation of JP-2004124711-A.*
(Continued)

*Primary Examiner* — Dominick L Plakkoottam
*Assistant Examiner* — Charles W Nichols
(74) *Attorney, Agent, or Firm* — Crowell & Moring LLP

(57) ABSTRACT

The purpose of the present invention is to provide a reciprocating compressor which is a compact, light-weight, portable air compressor such that deterioration of performance due to problems such as wear on the surface finish of the cylinder when the compressor is used for a long period of time outside the operating temperature range thereof is prevented. To achieve this, the cylinder temperature is detected, and control is carried out so that the compressor is restarted at a lower restart pressure when the temperature is lower than a prescribed value and stopped (and also restarted, preferably) at a low pressure when the temperature is higher than a prescribed value.

15 Claims, 7 Drawing Sheets

(51) Int. Cl.

| | |
|---|---|
| ***F04B 49/06*** | (2006.01) |
| ***F04B 49/10*** | (2006.01) |
| ***F04B 41/02*** | (2006.01) |
| *F04B 39/00* | (2006.01) |
| *F04B 39/06* | (2006.01) |
| *F04B 27/053* | (2006.01) |

(52) U.S. Cl.
CPC ..... *F04B 49/06* (2013.01); *F04B 49/10* (2013.01); *F04B 27/0538* (2013.01); *F04B 39/0094* (2013.01); *F04B 39/066* (2013.01); *F04B 2201/0801* (2013.01); *F04B 2205/063* (2013.01)

(58) Field of Classification Search
CPC .... F04B 35/06; F04B 39/066; F04B 39/0094; F04B 41/02; F04B 49/02; F04B 49/022; F04B 49/06; F04B 49/10; F04B 2201/0801; F04B 2203/0205; F04B 2203/0405; F04B 2203/0601; F04B 2205/11
See application file for complete search history.

(56) References Cited

FOREIGN PATENT DOCUMENTS

| | | | |
|---|---|---|---|
| JP | 2011-58445 | A | 3/2011 |
| JP | 5353873 | B2 | 11/2013 |
| JP | 5517715 | B2 | 6/2014 |
| JP | 2015-45266 | A | 3/2015 |
| WO | WO 2012/017939 | A1 | 2/2012 |

OTHER PUBLICATIONS

International Search Report (PCT/ISA/210) issued in PCT Application No. PCT/JP2016/086443 dated Mar. 7, 2017 with English translation (three pages).
German-language Written Opinion (PCT/ISA/237) issued in PCT Application No. PCT/JP2016/086443 dated Mar. 7, 2017 (four pages).
Extended European Search Report issued in European Application No. 16923400.2 dated Apr. 15, 2020 (10 pages).

* cited by examiner

| No. | OPERATION MODE | PRESSURE CONTROL RANGE | | MAXIMUM ROTATIONAL SPEED ($min^{-1}$) |
|---|---|---|---|---|
| | | RESTART PRESSURE (MPa) | STOP PRESSURE (MPa) | |
| 1 | NORMAL MODE | 3.2 | 4.2 | 2800 |
| 2 | POWERFUL MODE | 3.8 | 4.2 | 2800 |
| 3 | LOW SPEED OPERATION MODE | 3.2 | 4.2 | 1500 |

RECIPROCATING COMPRESSOR AND CONTROL METHOD THEREFOR

TECHNICAL FIELD

The present invention relates to a reciprocating compressor and a control method therefor.

BACKGROUND ART

In Patent Document 1, a control method in which, in an air compressor including a compressor body that compresses air, an air tank that stores the compressed air, and a control device that controls an operation of the compressor body, in order to prevent a decrease in the diameter of an air compression ring in a cold state, the rotational speed of the compressor is increased to cause the ring to be heated and thermally expanded such that deterioration of performance of a seal due to the decrease in the diameter of the ring is prevented is described.

CITATION LIST

Patent Document

Patent Document 1: JP 5353873 B2

SUMMARY OF THE INVENTION

Problems to be Solved by the Invention

A reciprocating compressor which is a light-weight, portable air compressor used as an air source for a nail gun or a coating machine is a device that is often used or stored outdoors and is used in a wide temperature range.

Normally, the usable temperature range of a compressor is generally set to around 0° C. to 40° C. However, in a case of use outside the use temperature range, there is a risk that leads to a decrease in the life, failure, and the like of the compressor.

In a case of use at a high temperature outside the use temperature range, there is a possibility that problems such as overheating of the compressor body and an increase in the wear amount of the ring due to ring softening may be incurred. However, a temperature sensor is provided for the compressor body and control, and in a case where a motor temperature reaches a predetermined temperature or higher, a protection measure for stopping the compressor due to the error is installed.

On the other hand, in a case of use at a low temperature outside the use temperature range, there are concerns about poor discharge of compressed air due to freezing of the drain accumulated in an air tank, a decrease in the life caused by wear or the like of cylinder alumite due to hardening of a compression ring, and the like. However, no special protection is considered.

The present invention solves the problems in the related art and provides a reciprocating compressor and a control method therefor capable of enabling stable use even outside a use temperature range.

Solutions to Problems

In order to solve the problems, in the present invention, a reciprocating compressor includes: a compressor body in which a piston reciprocates in a cylinder to compress a fluid; a motor which drives the compressor body; a controller which controls the compressor body; and a tank which stores the fluid compressed in the compressor body, in which the controller controls the compressor body to start the compressor body when a pressure of the fluid in the tank becomes equal to or lower than a start pressure, and stop the compressor body when the pressure of the fluid becomes equal to or higher than a stop pressure, and the controller sets, of at least one of the start pressure and the stop pressure, a pressure applied in a case where a measurement temperature of a temperature sensor attached to the reciprocating compressor is outside a predetermined temperature range to be lower than a pressure applied in a case where the measurement temperature of the temperature sensor is within the predetermined temperature range.

In addition, in order to solve the problems, in the present invention, a control method for a reciprocating compressor includes: driving a piston using a motor so as to cause the piston to reciprocate in a cylinder and compress a fluid; storing the compressed fluid in a tank; stopping the motor when a pressure of the compressed fluid stored in the tank becomes higher than a stop pressure set in advance; and starting the motor when the pressure of the compressed fluid stored in the tank becomes lower than a start pressure set in advance and storing the fluid compressed in the cylinder in the tank, in which, in a case where a measurement temperature by a temperature sensor attached to the reciprocating compressor deviates from a temperature range set in advance, control of starting or stopping of the motor is carried out by decreasing at least one of the start pressure and the stop pressure.

Effects of the Invention

According to the present invention, it is possible to stably use the compressor even outside the use temperature range.

MODE FOR CARRYING OUT THE INVENTION

Figure 1:
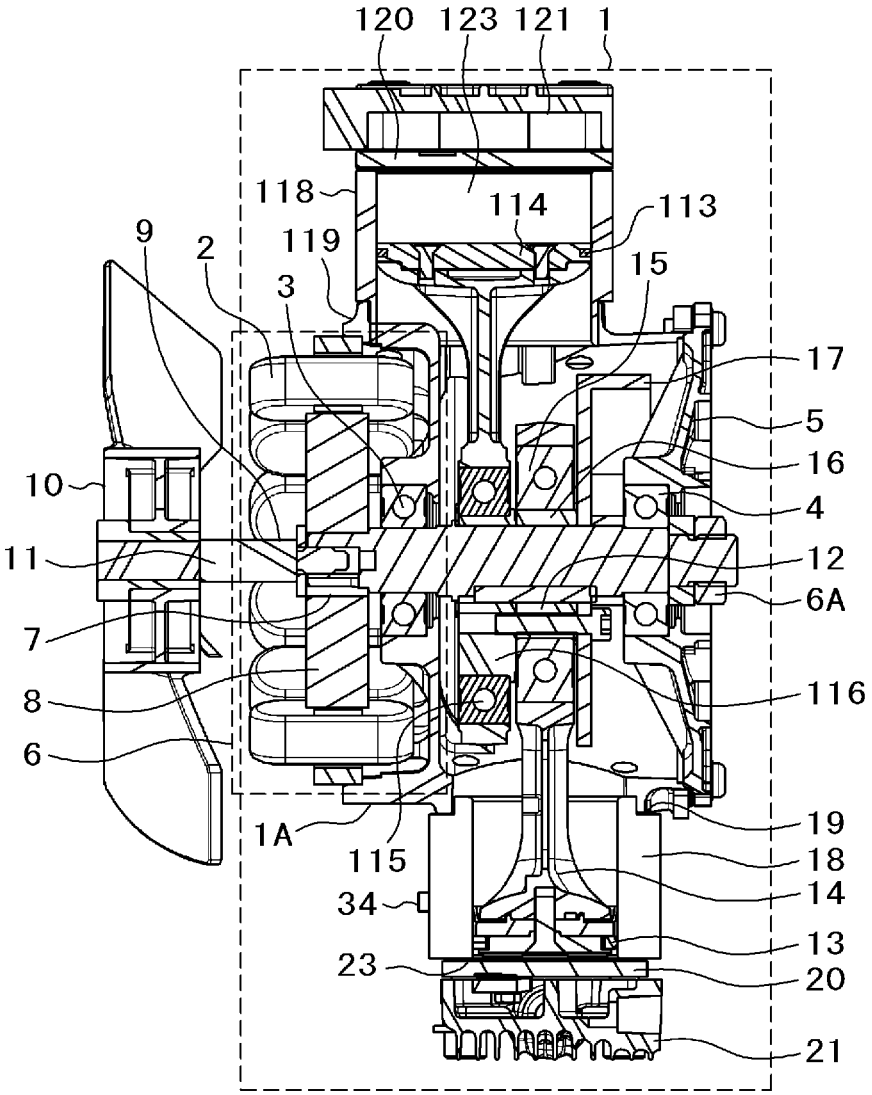
FIG. 1 is a sectional view of a body of a reciprocating compressor according to Example 1 of the present invention.

The present invention relates to a light-weight, portable air compressor used as an air source for a nail gun or a coating machine, the air compressor being able to be stably used even in a cold state or a high temperature state exceeding a range of 0° C. to 40° C., which is a normally usable temperature range.

That is, in the present invention, in an air compressor in which outside air (air) is drawn into a multi-stage cylinder and is compressed in stages, the compressed air in a high pressure state is stored in a storage tank, and the stored air in a high pressure state is supplied as an air source for a nail gun or a coating machine as necessary, the cylinder is provided with temperature detecting means, an operation control pressure of the air compressor is changed depending on the temperature of the cylinder detected by the temperature detecting means, whereby the cylinder does not receive a large load when driving and stopping of the cylinder are repeated, wear on the cylinder is thus suppressed, and stable use even in a cold state or a high temperature state is possible.

The cylinder provided in the air compressor is formed of an aluminum or iron-based material in many cases, and a surface treatment such as alumite or a coating treatment is generally carried out for rust prevention and a decrease in sliding resistance against a compression ring.

In a case of use at a low temperature outside a use temperature range, the compression ring attached to a piston side is hardened due to a temperature change. When the hardened ring slides in a state of being pressed against the cylinder at a high pressure, a strong force is applied to the inner surface of the cylinder, and a material formed by subjecting the inner surface of the cylinder to a surface treatment such as alumite wears and disappears. When the material formed by the surface treatment disappears due to the wear, the seal between the compression ring attached to the piston side and the cylinder becomes incomplete, leakage of air from the compression ring occurs, and the performance of the compressor deteriorates.

A compressor for a current nail gun has increased in pressure, so that a pressure applied to a ring is also high. As the ring on the piston side is pressed against the cylinder at a higher pressure, the wear amount of the surface finish of the cylinder increases. Particularly in a compressor in which pressure control is carried out, a condition of restart at a relatively high pressure from a stopped state is a more severe condition in terms of wear on the surface finish of the cylinder than when the compression ring becomes cold and is thus hardened.

In a case where the air compressor is restarted in a state in which the temperature of the cylinder is decreased, by decreasing a restart pressure of the air compressor, a force pressing the cylinder in a state in which the compression ring is hardened at a high temperature can be reduced, so that deterioration of performance due to wear on the surface finish of the cylinder (a reduction in the life and a reduction in the maintenance cycle) can be prevented.

On the other hand, in a case where the air compressor is used at a high temperature outside the use temperature range, the air compressor can be stopped by detecting an error such as overheating when the air compressor is used for a long period of time. However, in a case of use for a short period of time at a level at which the air compressor is not stopped by overheating or the like, there is a possibility that wear of the ring may be accelerated as the compression ring which is in a state of being softened due to a temperature decrease is pressed against and slides on the cylinder at a high temperature.

In the present invention, when the cylinder temperature decreases, acceleration of wear of the compression ring is prevented by decreasing a stop pressure of the compressor. However, at this time, when only the stop pressure is decreased, the pressure difference from the restart pressure decreases and the operation frequency of the compressor increases. Therefore, the restart pressure is also decreased when the stop pressure is decreased.

In addition, in the present invention, a temperature sensor which is provided in the air compressor in advance is used to estimate the cylinder temperature, and in a case where the cylinder temperature is lower than a prescribed value set in advance, the restart pressure of the air compressor to be operated under pressure control is decreased. In contrast, in a case where the cylinder temperature is higher than the prescribed value set in advance, the restart pressure and the stop pressure of the air compressor are decreased.

In all the drawings for explaining this embodiment, those having the same function are denoted by the same reference numeral, and repeated descriptions will be omitted in principle. Hereinafter, the embodiment of the embodiment will be described in detail with reference to the drawings.

However, the present invention is not construed as being limited to the description of the embodiment described below. It will be easily understood by those skilled in the art that specific configuration can be changed without departing from the spirit and gist of the present invention.

Example 1

First, the structure of a compressor body 1 which compresses air in a tank integrated air compressor according to Example 1 of the present invention will be described below with reference to FIGS. 1 to 4.

In this example, when the temperature of the cylinder decreases, by decreasing the restart pressure of the air compressor, the force pressing the cylinder in a state in which the compression ring is hardened at a high temperature is reduced such that deterioration of performance due to wear on the surface finish of the cylinder (a reduction in the life and a reduction in the maintenance cycle) is prevented.

In FIG. 1, reference numeral 1 surrounded by a large dashed frame denotes the compressor body that compresses air, and reference numeral 6 surrounded by a small dashed frame denotes a motor. The compressor body 1 includes a crankcase 1A, and cylinders 18 and 118 attached to the crankcase 1A. A shaft (rotating shaft) 6A of the motor 6 supported by bearings 3 and 4 penetrates through the crankcase 1A.

The crankcase 1A covers the compressor body 1 and the motor 6. A structure in which a stator 2 is directly fixed to and the bearing 3 that supports the shaft 6A is mounted on one end side of the crankcase 1A, and a bearing housing 5 in which the bearing 4 that supports the shaft 6A is mounted is fitted to the side opposite to the side to which the stator 2 is attached.

A key 12 is buried in a central portion of the shaft 6A that penetrates through the inside of the crankcase 1A. The shaft 6A in which the key 12 is buried is inserted into a connecting rod set 14 having a piston ring 13 for sealing and compressing the air, together with a balance 17 via a bearing 15 and an eccentric 16 which is eccentric. The connecting rod set 14 and the balance 17 are supported from both sides by the two bearings 3 and 4 attached to the crankcase 1A and the bearing housing 5.

In addition, the shaft 6A in which the key 12 is buried is also inserted into a connecting rod set 114 having a piston ring 113 for sealing and compressing the air, via a bearing 115 and an eccentric 116 which is eccentric.

Reference numeral 6 surrounded by a small dashed frame denotes the motor which drives the compressor body 1. The motor 6 has the stator 2, the bearing 3, the shaft 6A, a key 7, a rotor 8, and a washer 9, and a cooling fan 10 is attached to an end portion of the shaft 6A. The rotor 8 is attached to one end side of the shaft 6A via the key 7. The rotor 8 is fixed in an axial direction by a fan shaft 11 for attaching the washer 9 and the cooling fan 10.

Reference numeral 10 denotes a cooling fan for cooling the constituent elements of the tank integrated air compressor such as the compressor body 1 and storage tanks 24 and 25 by supplying cooling wind into a cover 26, which will be described later. The cooling fan 10 is provided at the end portion of the shaft 6A by the fan shaft 11 and is driven by the motor 6.

Reference numerals 18 and 118 denote cylinders each attached to the crankcase 1A. In this example, a pair of the cylinders 18 and 118 are provided, and the pair of cylinders and 118 are attached to oppose each other with the crankcase 1A interposed therebetween.

The cylinder 18 includes a flange 19 and an air valve 20. The crankcase 1A is provided with the flange 19 for attaching the cylinder 18, and the cylinder 18, the air valve 20, and a cylinder head 21 are fixed to the flange 19 to form a compression chamber 23. Temperature detecting means 34 such as a thermometer is fixed to the outer wall surface of the cylinder 18 and monitors the temperature of the wall surface of the cylinder 18.

On the other hand, the cylinder 118 includes a flange 119 and an air valve 120. The crankcase 1A is provided with the flange 119 for attaching the cylinder 118, and the cylinder 118, the air valve 120, and a cylinder head 121 are fixed to the flange 119 to form a compression chamber 123.

The operation of the compressor body 1 in this example will be described. In the compressor body 1 in this example, when the shaft 6A is rotated by supplying power from a power source (not illustrated) and driving the rotor 8, the connecting rod set 114 and the piston ring 113 reciprocate in the compression chamber 123 by the eccentric 116. In an intake stroke in which the piston ring 113 moves from top dead center to bottom head center, the air is drawn into the compression chamber 123 through the cylinder head 121 and the air valve 120, and in contrast, in an exhaust stroke toward top dead center, the drawn air is discharged through the air valve 120 and the cylinder head 121 while being compressed.

The air discharged through the cylinder head 121 is further sent to the other cylinder 18. In the cylinder 18, in an intake stroke in which the piston ring 13 moves from top dead center to bottom dead center by the rotation of the shaft 6A, the air compressed by the cylinder 118 in the compression chamber 23 is drawn through the cylinder head 21 and the air valve, and in contrast, in an exhaust stroke toward top dead center, the drawn air is discharged through the air valve 20 and the cylinder head 21 while being further compressed. The compressed air which is discharged is stored in the storage tanks 24 and 25, which will be described later. In this example, the air is efficiently compressed by carrying out two-stage compression in which the air compressed by one cylinder 118 is further compressed by the other cylinder 18.

Figures 2, 3:
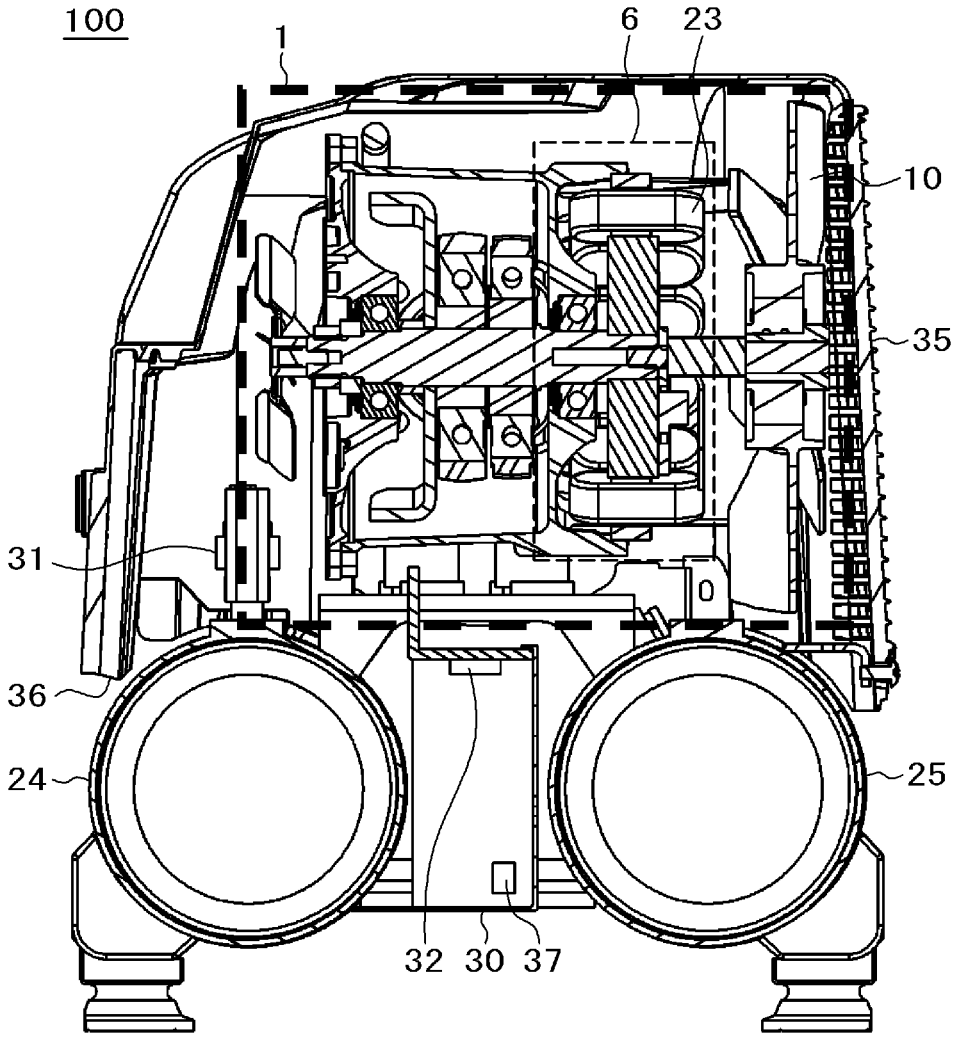
FIG. 2 is a side view illustrating the outer appearance of the reciprocating compressor according to Example 1 of the present invention.
FIG. 3 is a table showing the relationship between operation modes and pressure control ranges of a reciprocating compressor and maximum rotational speeds of a motor according to Modification Example 1 of the present invention.

Next, control of the compressor body 1 in this example will be described. FIG. 2 is a sectional view of a tank integrated air compressor 100. In this embodiment, the compressor body 1 described with reference to FIG. 1 is disposed on the two storage tanks 24 and 25, and a control set that controls the operation of the tank integrated air compressor 100 is disposed between the two storage tanks 24 and 25. A configuration in which, by rotating the cooling fan 10 by driving the motor 6, outside air is drawn from an intake port 35, cools the compressor body 1, and is discharged from an exhaust port 36.

The tank integrated air compressor 100 adopts a pressure operation control method, and control of the operation of the compressor body 1 is carried out by the control set 30 depending on the pressure sensed by a pressure sensor 31 attached to the storage tank 24.

In a light-weight, portable air compressor used for a nail gun or the like, several patterns of operation modes are generally provided depending on work contents and environments, and the operation modes are set by changing a pressure control range or changing the rotational speed of the motor 6 using an inverter in many cases.

For example, the tank integrated air compressor 100 according to this example has three operation modes shown in the column of operation mode 301 in FIG. 3. Pressure control range 302 refers to operation control carried out so that when the pressure of the storage tanks 24 and 25 reaches a predetermined set pressure (stop pressure 304), the operation of the compressor body 1 is stopped, and in a case where the pressure of the storage tanks 24 and 25 becomes equal to or less than a predetermined set pressure (restart pressure 303), the compressor body 1 is restarted. Maximum rotational speed 305 prescribes the maximum value of the rotational speed of the motor 6.

In the three operation modes shown in the column of operation mode 301 in FIG. 3, an example in which two pressure control ranges of restart pressure 303 and stop pressure 304 are set in the column of pressure control range 302 is shown. In a case where operation mode 301 is a powerful mode, the powerful mode is an operation mode which is effective when the use amount of compressed air is large because restart pressure 303 of the compressor body 1 is set to be high and when even a small amount of the compressed air stored in the storage tanks 24 and 25 is used, the compressor body 1 is restarted to start filling the storage tanks 24 and 25 earlier.

While the case where operation mode 301 is the powerful mode is effective in a case where the amount of air used is large, there is also a problem that restart pressure 303 is high. For example, there are problems that wear is accelerated as an average load applied to the piston rings 13 and 113 increases, and the life of the bearings 15 and 115 is shortened as an average load applied to the bearings 15 and 115 increases. However, these can be coped with by design such as optimization of the shape of the piston rings 13 and 113 and an increase in the size of the bearings 15 and 115.

On the other hand, due to the problem of the wear on the sliding surface of the cylinder, which is a characteristic of a high pressure air compressor, a high powerful mode of restart pressure 303 causes acceleration of wear. The most severe condition of the wear on the sliding surface of the cylinder is as follows. The temperature of the piston rings 13 and 113 decreases due to lying in the open air at a low temperature for a long period of time, and the piston rings 13 and 113 are hardened due to the temperature decrease. As the hardened piston rings 13 and 113 slide while being pressed against the inner surfaces of the cylinders 18 and 118 at high restart pressure 303, the inner sliding surfaces of the cylinders 18 and 118 wear.

Although depending on the materials of the piston rings 13 and 113 and the cylinders 18 and 118, in the high pressure air compressor used for a nail gun, a PEFE (polytetrafluoroethylene: tetrafluoroethylene resin)-based material is used as the material of the piston ring, the materials of the cylinders 18 and 118 are subjected to an exterior treatment such as aluminum and alumite in many cases, and in the materials, as the ring temperature decreases and the pressure increases, wear on the sliding surfaces of the cylinders 18 and 118 is accelerated. Therefore, in a combination of the materials of the piston rings 13 and 113 and the cylinders 18 and 118, minimum temperatures and maximum restart pressures which are usable are set, and this is taken as the specification of the tank integrated air compressor 100. In the compressor, the minimum temperature is set to 0° C., and the restart pressure is set to 3.8 MPa.

Even from the viewpoint of freezing of the drain stored in the storage tanks 24 and 25 together with the compressed air, the use minimum temperature of an existing air compressor is set to 0° C. However, in a case of outdoor use at sub-zero temperatures, wear on the sliding surface of the cylinder is accelerated, and components such as the cylinder need to be replaced earlier than a normal maintenance cycle.

The tank integrated air compressor 100 in this example solves the above-described problems, but solutions to the problems will be described with reference to FIGS. 1, 2, 4, and 5.

Figure 4:
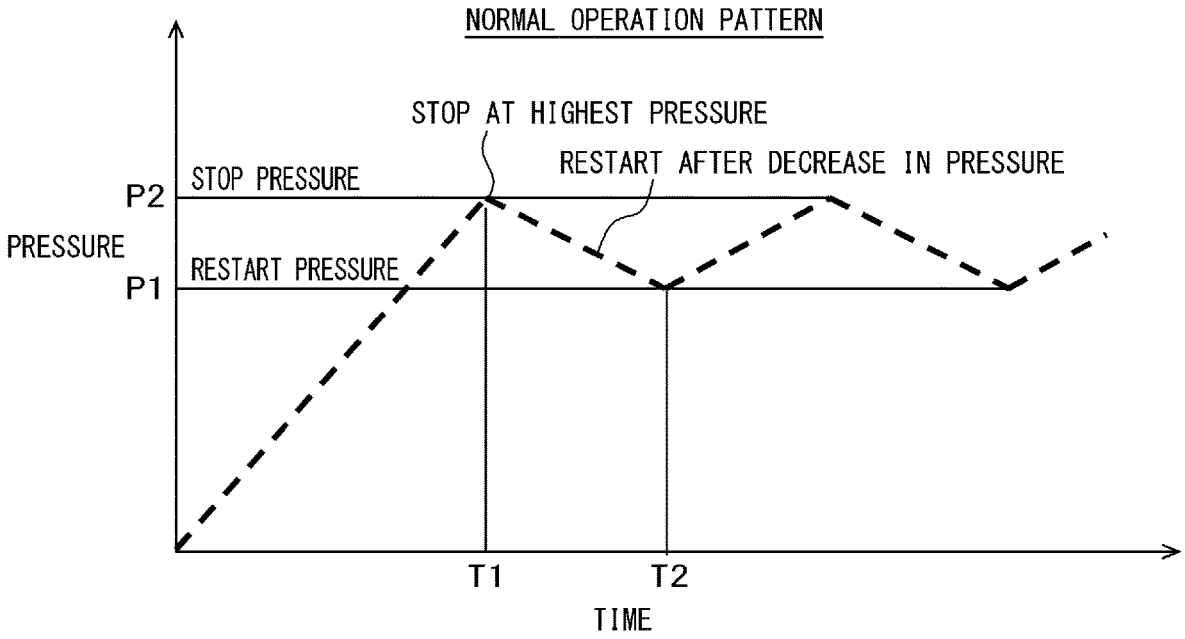
FIG. 4 is a graph showing a normal operation pattern as a comparative example of Example 1 of the present invention.

FIG. 4 is a graph showing an operation pattern of a normal compressor for comparison to this example. The horizontal axis represents time, and the vertical axis represents the pressure of compressed air in a flow passage in or in the vicinity of a storage tank. When a predetermined time has elapsed after the start of an operation of the compressor and the pressure of the storage tank reaches stop pressure P2, the operation is stopped. When an operator uses the compressed air in the storage tank and the pressure in the storage tank decreases to restart pressure P1, the operation of the compressor is resumed. In a case where the pressure in the storage tank has reached stop pressure P2, the compressor stops the operation again.

Contrary to this, in the tank integrated air compressor 100 in this example illustrated in FIG. 2, temperature detecting means 32 and 33 for product protection are provided for the control set 30 and the motor 6. In the compressor, when at least one of the temperature of the control set 30 and the temperature of the motor 6 deviates from a prescribed value (deviates from a temperature range set in advance), a warning sound is emitted from a notifier 37 to turn on a lamp, and operation control is carried out to stop the compressor body 1.

In order to solve the problem of accelerating the wear on the sliding surfaces of the cylinders 18 and 118 in a case where the product is used outside the use temperature range, as illustrated in FIG. 1, the temperature of the cylinder 18 is detected by the temperature detecting means 34 attached to the outer wall surface of the cylinder 18, and in a case where the temperature is equal to or lower than the prescribed value, it is effective to decrease restart pressure 303 in the table shown in FIG. 3.

Figure 5:
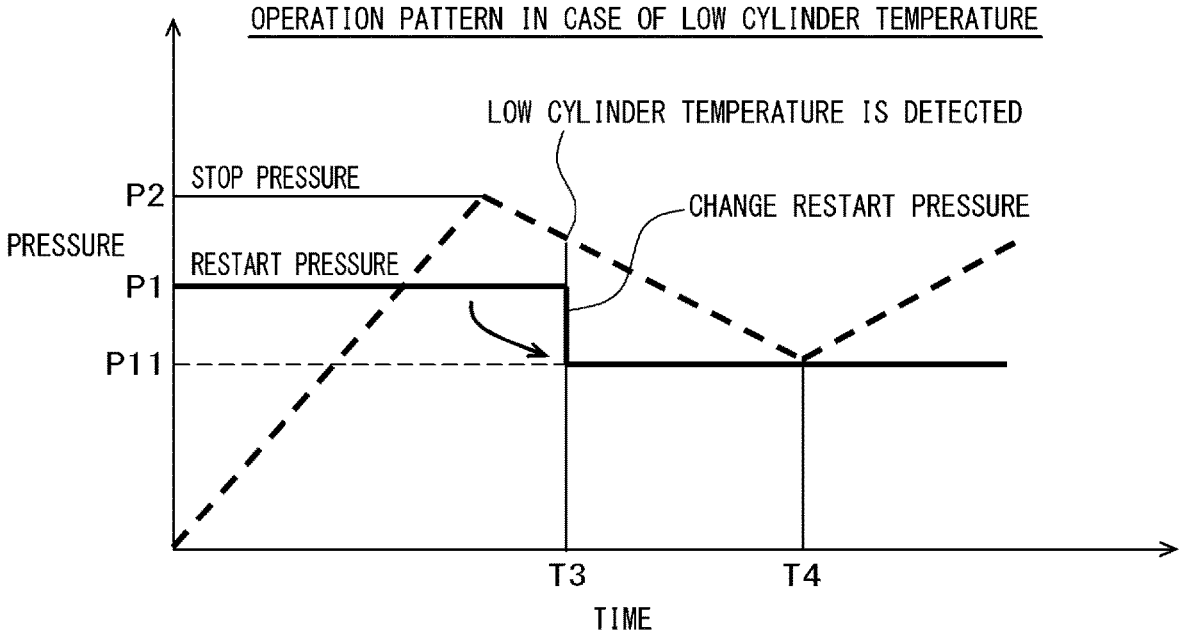
FIG. 5 is a graph showing an operation pattern in a case where the temperature of the cylinder of the reciprocating compressor according to Example 1 of the present invention is low.

The graph shown in FIG. 5 is an operation pattern of the tank integrated air compressor 100 applied to this example in order to solve the problem. The temperature of the outer wall surface of the cylinder 18 is detected by the temperature detecting means 34 provided on the outer wall surface of the cylinder 18, and in a case where the temperature of the outer wall surface of the cylinder 18 is the prescribed value (for example, 0° C. or less), restart pressure 303 shown in the table in FIG. 3 is decreased to be lower than standard set value P1 and is set to P11.

For example, in a case where operation mode 301 in FIG. 3 is the powerful mode, restart pressure 303 is decreased to 2.5 MPa from 3.8 MPa set in a case where the temperature of the outer wall surface of the cylinder 18 is in a range of the prescribed value. Accordingly, regarding the piston rings 13 and 113 formed of a Teflon (trade name)-based material hardened in a state where the temperature of the outer wall surface of the cylinder 18 is lower than the prescribed value, the amount of the piston rings 13 and 113 receiving a high pressure in the cylinders 18 and 118 and expanding can be reduced.

As a result, the amount of change in the outer diameter of the piston rings 13 and 113 (the amount by which the outer diameter increases) can be reduced compared to a case where the restart pressure is not decreased, and the wear amount of the sliding surfaces of the inner wall surfaces of the cylinders 18 and 118 can be suppressed.

A process flow (flow) of the operation control of the tank integrated air compressor 100 according to this example described above will be described with reference to FIG. 6.

First, an operation is started by starting the motor 6 of the compressor body 1 via the control set 30 using input means such as a switch (not illustrated) (S601). Next, the pressure of the air inside the storage tank 24 is detected by the pressure sensor 31 to check whether or not the internal pressure of the storage tank 24 has reached stop pressure: 304 set in advance (S602).

In a case where the internal pressure of the storage tank 24 has not yet reached stop pressure 304 set in advance (in a case of NO in S602), the operation of the compressor body 1 is continued.

In a case where the internal pressure of the storage tank 24 has reached stop pressure 304 set in advance (in a case of YES in S602), the operation of the compressor body 1 is stopped by stopping the driving of the motor 6 of the compressor body 1 (S603).

The internal pressure of the storage tank 24 is monitored by the pressure sensor 31 in a state in which the operation of the compressor body 1 is stopped (S604), and in a case where the internal pressure of the storage tank 24 has not decreased to restart pressure 303 set in advance (in a case of NO in S604), the state of operation stop S603 is continued.

In a case where the internal pressure of the storage tank 24 has decreased to restart pressure 303 set in advance (in a case of YES in S604), it is checked whether or not the temperature (θ1) of the outer wall surface of the cylinder 18 detected by the temperature detecting means 34 is equal to or higher than the prescribed value set in advance (S605). In a case where the temperature (θ1) of the outer wall surface of the cylinder 18 is equal to or higher than the prescribed value (in a case of YES in S605), the motor 6 of the compressor body 1 is restarted to resume the operation (S606), and the process returns to S602. The internal pressure of the storage tank 24 is checked.

On the other hand, in a case where the temperature (θ1) of the outer wall surface of the cylinder 18 has not reached the prescribed value (in a case of NO in S605), the restart pressure in the case where the temperature (θ1) of the outer wall surface set in advance has not reached the prescribed value is reset (S607), and it is checked whether or not the internal pressure of the storage tank 24 monitored by the pressure sensor 31 has reached the reset restart pressure (S608). In a case where the internal pressure of the storage tank 24 has not reached the reset restart pressure (in a case of NO in S608), monitoring of the internal pressure of the storage tank 24 is continued. In a case where the internal pressure of the storage tank 24 has reached the reset restart pressure (in a case of YES in S608), the process proceeds to S606 and the operation is resumed by restarting the motor 6 of the compressor body 1.

Even in a case where the operation is resumed in S606 on the basis of the restart pressure reset as described above, steps S602 to S604 are repeated in a subsequent cycle, and in a case where it is determined in S605 that the temperature (θ1) of the outer wall surface of the cylinder 18 has reached the prescribed value (set temperature) (in a case of YES), the operation is resumed on the basis of the restart pressure determined in S604.

That is, even in a case where the temperature (θ1) of the outer wall surface of the cylinder 18 has not reached the prescribed value (set temperature) at the time of the start of the operation or during the operation and an operation cycle in which restart is carried out in S606 in a case where the restart pressure reset in S607 has been reached is repeated, in a case where the temperature (θ1) of the outer wall surface of the cylinder 18 has reached the prescribed value (set temperature) at a certain point of time, restart of S606 is carried out on the basis of the set restart pressure used for the determination of S604.

In this case, in the graph shown in FIG. 5, restart is carried out by increasing the restart pressure temporarily decreased from P1 to P11.

These operations can be carried out by using operation modes with different pressure settings shown in FIG. 3. For example, in a case where the temperature (θ1) of the outer wall surface of the cylinder 18 has not reached the prescribed value (set temperature), even if an operation in the powerful mode is operated by an operation panel or the like, an operation is carried out in the normal mode. In a case where the temperature (θ1) of the outer wall surface of the cylinder has reached the prescribed value (set temperature) at a certain point of time, the operation mode is switched to the powerful mode. The use of the operation mode is not limited to this example and can be similarly applied to the following examples.

In this example, the temperature detecting means 34 is provided on the outer wall surface of the cylinder 18 in order to detect the temperature of the cylinder 18. However, a method for estimating the temperature of the cylinder 18 using values of the existing temperature detecting means 32 and 33 may also be provided. There is a correlation between the temperature of the control set 30 and the temperature of the motor 6, and the temperature of the cylinder 18, and by checking this in advance, the temperature of the cylinder 18 can be estimated from any one or both of the temperature of the control set 30 and the temperature of the motor 6.

Figure 6:
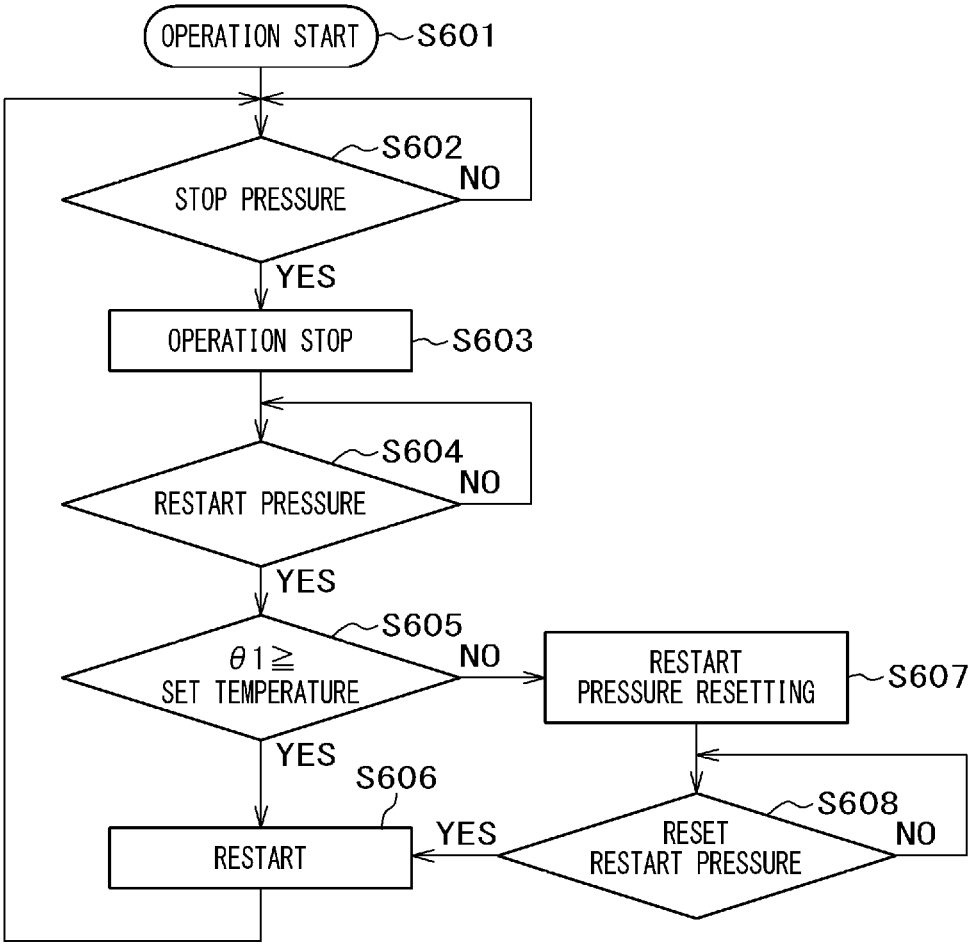
FIG. 6 is a flowchart showing a flow of operation control of the reciprocating compressor according to Example 1 of the present invention.

In addition, the processing flow described with reference to FIG. 6 may be carried out by measuring the temperature of the compressed and discharged by the cylinder 18 and using the temperature of the compressed air as θ1. That is, in S605, in a case where the temperature θ1 of the air compressed and discharged by the cylinder 18 deviates from a predetermined temperature range set in advance (in a case of NO in S605), the restart pressure is reset in S607, and when the temperature θ1 of the air compressed and discharged by the cylinder 18 is within the predetermined temperature range set in advance (in a case of YES in S605), the compressor body 1 may be restarted in S606.

As described above, in a case where the product is used at a low temperature outside the use temperature range, even when the cylinder temperature decreases, acceleration of wear on the sliding surface of the cylinder can be prevented, and it is possible to prevent shortening of the maintenance cycle and deterioration of performance.

Modification Example

Figure 7:
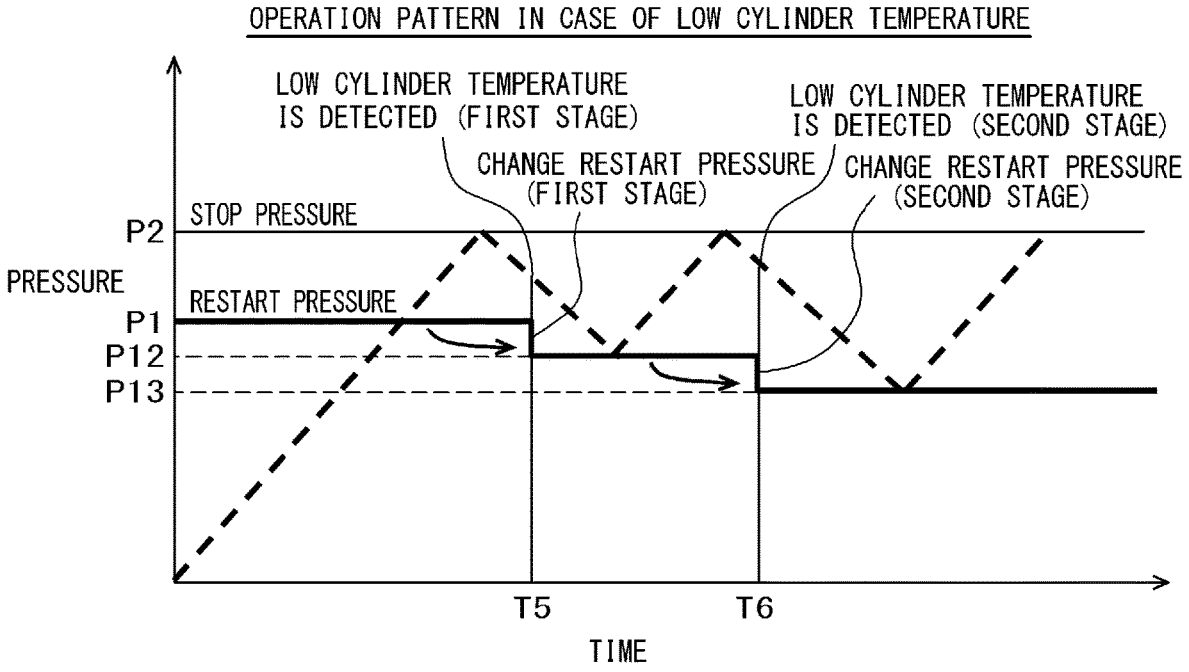
FIG. 7 is a graph showing a modification example of the operation pattern of the reciprocating compressor according to Example 1 of the present invention.
Figure 8:
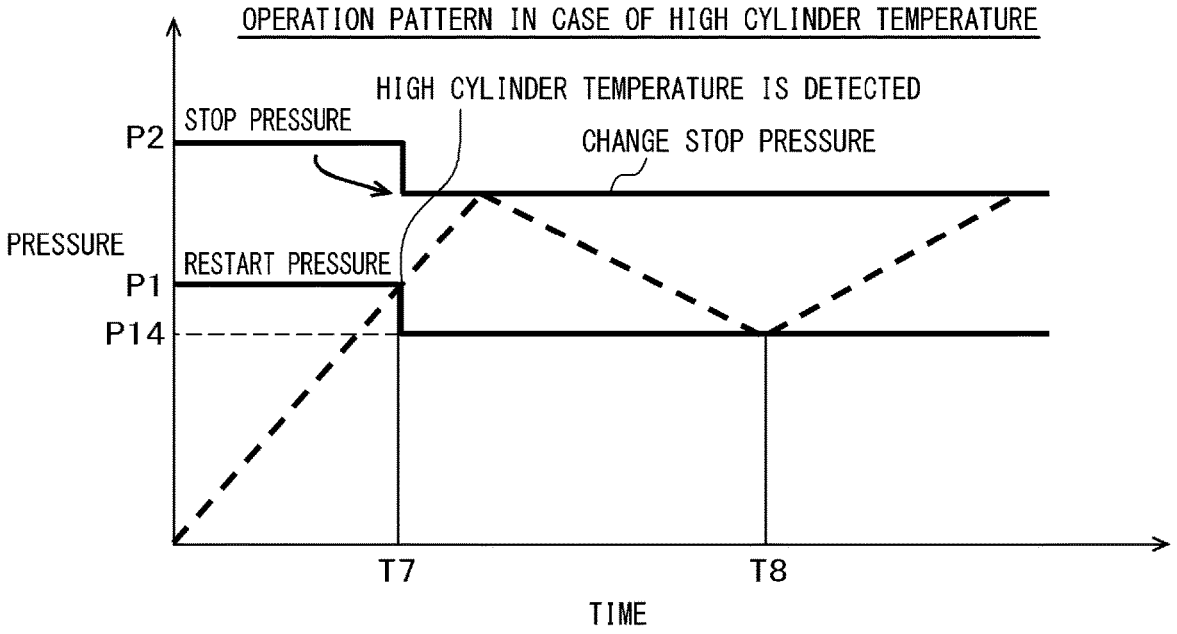
FIG. 8 is a graph showing an operation pattern of the reciprocating compressor according to Example 2 of the present invention.

FIG. 7 shows a modification example of this example. When the temperature of the cylinder 18 detected by the temperature detecting means 34 falls below the prescribed value, for example, in a case where the compressor is used at a low temperature outside the use temperature range, the restart pressure is not reduced at once, but a control pressure is reduced in stages depending on the cylinder temperature as shown in FIG. 8.

In this case, in the step in S607 in the flowchart described with reference to FIG. 6, in a case where the temperature (θ1) of the outer wall surface of the cylinder 18 has not reached the prescribed value (in a case of NO in S605), instead of resetting to the restart pressure in the case where the temperature (θ1) of the outer wall surface set in advance has not reached the prescribed value, a restart pressure according to the temperature (θ1) of the outer wall surface of the cylinder 18 stored in advance may be reset.

According to this, the reliability of the piston rings and the cylinders can be maintained without abruptly reducing the amount of generated compressed air.

Example 2

A control method for a tank integrated air compressor according to Example 2 of the present invention will be described with reference to FIGS. 1, 2, 5, and 7.

This example solves a problem that, in a case where the tank integrated air compressor is used at a high temperature outside the use temperature range, while the compressor is stopped due to an error such as overheating when the compressor is used for a long period of time, in a case where the compressor is used for a short period of time at a level at which the compressor is not stopped, when a compression ring is pressed against a cylinder and slides in a state of being softened due to a temperature decrease, there is a possibility that wear on the ring may be accelerated, and enables prevention of the acceleration of wear on the compression ring by decreasing the stop pressure and the restart pressure of the compressor when the cylinder temperature increases.

The configuration of the tank integrated air compressor in this example is basically the same as that illustrated in FIGS. 1 and 2 described in Example 1. In a case where the tank integrated air compressor 100 illustrated in FIG. 2 is used at a high temperature outside the use temperature range, the piston rings 13 and 113 on the cylinder 18 side and the cylinder 118 side of the compressor body 1 are softened, and there is concern that when the piston rings 13 and 113 are pressed against the cylinders 18 and 118 by the pressure of the air during the compression and the piston rings 13 and 113 slide in the cylinders 18 and 118 by the operation of the compressor, wear of the softened piston rings 13 and 113 may be accelerated.

In general, operation conditions of the compressor where wear is accelerated include a case where the temperature of the piston rings 13 and 113 is high and a large load is applied to the piston rings 13 and 113, that is, a case where an ambient temperature is high and the compressor is continuously operated at a high pressure. The upper limit of the use temperature range of the compressor is set to 40° C. on the basis of the result of a life calculation and the result of a reliability test of each component. In a case of use at a high temperature outside the use temperature range of the product, there is a problem that the temperatures of the cylinders 18 and 118 and the piston rings 13 and 113 increase, wear of the piston rings 13 and 113 is accelerated, and the maintenance cycle is shortened.

A method for solving the above-described problems in this example will be described with reference to FIGS. 1 and 8. The temperature detecting means 34 for detecting the increase in the temperature of the cylinder 18 and the piston ring 13 is provided on the outer wall surface of the cylinder 18, and control is mounted in the control set 30 so that in a case where the temperature of the cylinder 18 detected by the temperature detecting means 34 exceeds the prescribed value and it is determined that the temperatures of the cylinder 18 and the piston ring 13 are high, the stop pressure is decreased to be lower than a stop pressure set on the premise that the temperature of the cylinder 18 is within the range of the prescribed value.

FIG. 8 shows an operation pattern of the tank integrated air compressor 100 in this example. In a case where the temperature of the outer wall surface of the cylinder 18 detected by the temperature detecting means 34 provided on the outer wall surface of the cylinder 18 is determined to be higher than the prescribed value determined in advance (in a state of T5 shown in FIG. 7), the stop pressure is decreased to be lower than the stop pressure (4.2 MPa in the compressor) set on the premise that the temperature of the cylinder 18 is within the range of the prescribed value. At this time, when only the stop pressure is decreased, the difference between the stop pressure and the restart pressure decreases, and there is a possibility that this may lead to an increase in the frequency of the operation of the compressor and an increase in the temperature. Therefore, the stop pressure is decreased from P2 to P21 and the restart pressure is also decreased from P1 to P14.

In a case where the normal mode among the three kinds of operation mode 301 of the compressor shown in FIG. 3 is set, for example, a stop pressure of 4.2 MPa and a restart pressure of 3.2 MPa which are normally set (in a case where the temperature of the outer wall surface of the cylinder 18 detected by the temperature detecting means 34 is assumed to be within the range of the prescribed value determined in advance) are changed to a stop pressure of 3.5 MPa and a restart pressure of 2.5 MPa, respectively.

Figure 9:
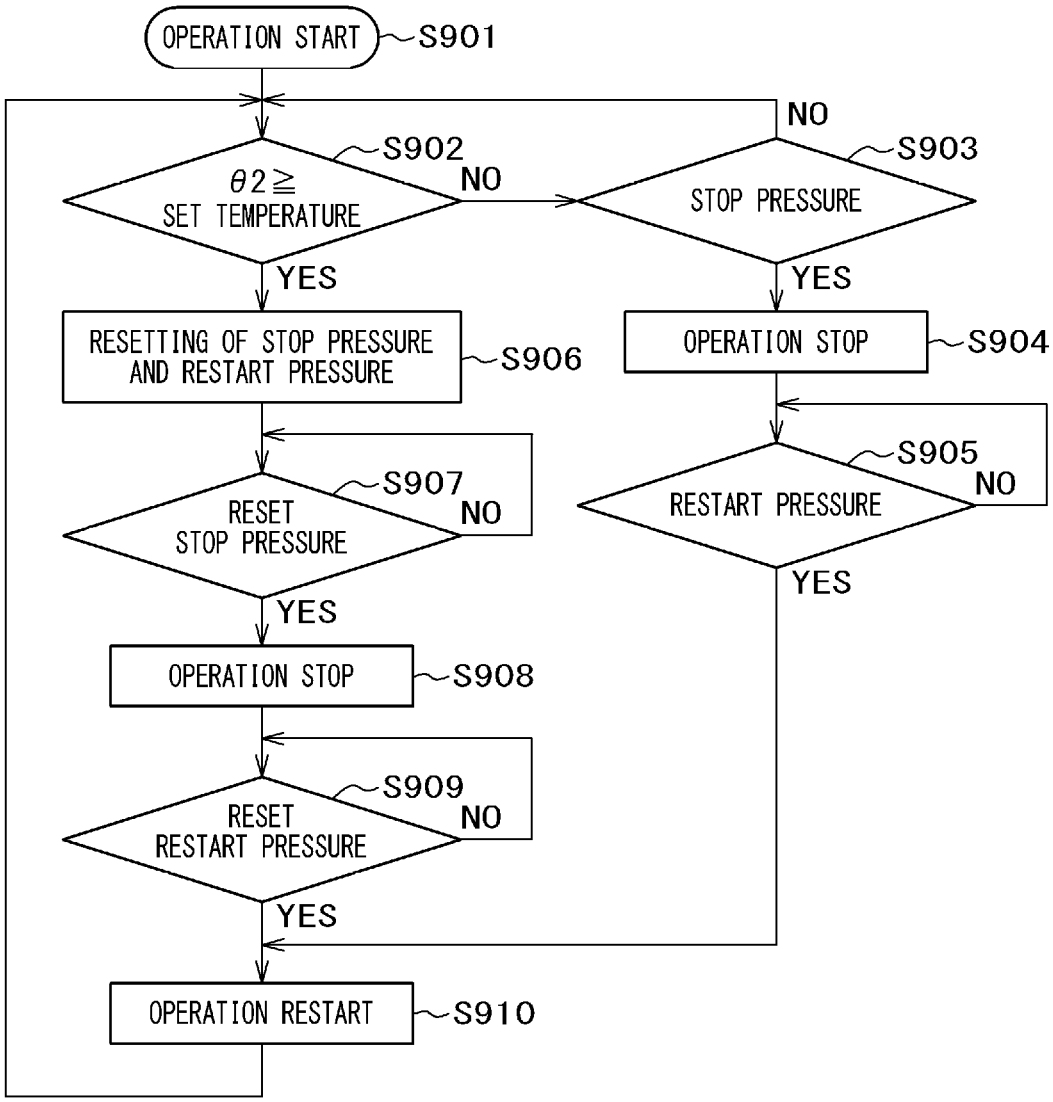
FIG. 9 is a flowchart showing a flow of operation control of the reciprocating compressor according to Example 2 of the present invention.

A process flow (flow) of the operation control of the tank integrated air compressor 100 according to this example described above will be described with reference to FIG. 9.

First, an operation is started by starting the motor 6 of the compressor body 1 via the control set 30 using input means such as a switch (not illustrated) (S901). Next, it is determined whether or not the temperature θ2 of the cylinder 18 detected by the temperature detecting means 32 attached to the cylinder 18 exceeds a temperature set in advance (S902). In a case where the temperature θ2 of the cylinder 18 detected by the temperature detecting means 32 does not exceed the temperature set in advance (in a case of NO in S902), the pressure of the air in the storage tank 24 is detected by the pressure sensor 31, and it is checked whether or not the internal pressure of the storage tank 24 has reached stop pressure: 304 set in advance (S903).

In a case where the internal pressure of the storage tank 24 has not yet reached stop pressure: 304 set in advance (in a case of NO in S903), the process returns to S902, and monitoring of the temperature θ2 of the cylinder 18 is continued in a state in which the operation of the compressor body 1 is continued.

On the other hand, in a case where the internal pressure of the storage tank 24 has reached stop pressure: 304 set in advance (in a case of YES in S903), the operation of the compressor body 1 is stopped by stopping the driving of the motor 6 of the compressor body 1 (S904), and it is monitored whether or not the internal pressure of the storage tank 24 has reached restart pressure: 304 set in advance (S905). In a case where the internal pressure of the storage tank 24 has not reached restart pressure: 304 set in advance (in a case of NO in S905), monitoring of the internal pressure of the storage tank 24 is continued in a state in which the operation of the compressor body 1 is stopped.

On the other hand, in a case where the internal pressure of the storage tank 24 has reached restart pressure: 304 set in advance (in a case of YES in S905), the operation of the compressor body 1 is resumed (S910).

In addition, in a case where the temperature θ2 of the cylinder 18 detected by the temperature detecting means 32 exceeds the temperature set in advance (in a case of YES in S902), the stop pressure and the restart pressure are reset as described with reference to FIG. 8 (S906), and it is monitored whether or not the internal pressure of the storage tank 24 has reached the reset stop pressure (S907).

In a case where the internal pressure of the storage tank 24 has not reached the reset stop pressure (in a case of NO in S907), monitoring of the internal pressure of the storage tank is continued in a state where the operation of the compressor body 1 is continued.

On the other hand, in a case where the internal pressure of the storage tank 24 has reached the reset stop pressure (in a case of YES in S907), the operation of the compressor body 1 is stopped by stopping the driving of the motor 6 of the compressor body 1 (S908), and it is monitored whether or not the internal pressure of the storage tank 24 has reached the reset restart pressure (S909). In a case where the internal pressure of the storage tank 24 has not reached the reset restart pressure (in a case of NO in S909), monitoring of the internal pressure of the storage tank 24 is continued in a state in which the operation of the compressor body 1 is stopped.

On the other hand, in a case where the internal pressure of the storage tank 24 has reached the restart pressure reset in advance (in a case of YES in S909), the operation of the compressor body 1 is resumed (S910), and the process returns to S902.

Even in a case where the temperature θ2 of the cylinder 18 exceeds the temperature set in advance (in a case of YES in S902) and the operation from S907 to S910 is carried out by resetting the stop pressure and the restart pressure in S906, in a case where it is determined that the temperature θ2 of the cylinder 18 does not exceed the temperature set in advance in a subsequent cycle (in a case of NO in S902), according to the flow from S903 to S910, stopping and resuming of the operation are carried out by using the stop pressure and the restart pressure set in advance.

That is, even in a case where the temperature θ2 of the outer wall surface of the cylinder 18 exceeds the prescribed value (set temperature) at the time of the start of the operation or during the operation and an operation cycle of stopping and resuming of the operation from S907 to S910 is repeated on the basis of the stop pressure and the restart pressure reset in S906, in a case where the temperature θ2 of the outer wall surface of the cylinder 18 becomes lower than the prescribed value (set temperature) at a certain point of time (in a case of NO in S902), on the basis of the preset stop pressure and the restart pressure used for the determination in S903 and S905, stopping of the operation in S904 and resuming the operation in S910 are carried out. In this case, in the graph shown in FIG. 8, restart is carried out by increasing the stop pressure temporarily decreased from P2 to P2 again and increasing the restart pressure temporarily decreased from P1 to P14 to P1.

According to this example, by resetting and decreasing the stop pressure, the compression ratio of the compressor body 1 is decreased and the amount of heat generated by the compression is also decreased, so that an increase in the temperatures of the cylinders 18 and 118 and the piston rings 13 and 113 can be prevented. Therefore, even in a case where a customer uses the compressor body 1 at a high temperature outside the use temperature range of the product, an increase in the temperatures of the cylinders 18 and 118 and the piston rings 13 and 113 to the prescribed value or higher can be prevented, so that wear of the piston rings 13 and 113 can be prevented from being extremely accelerated.

In addition, in a case where the temperatures of the cylinders 18 and 118 are high, other components of the compressor body 1 are at high temperatures in many cases. However, by changing the control temperature range of the compressor body 1 depending on the temperatures of the cylinders 18 and 118, it is possible to prevent a reduction in the lives of the bearings 3, 4, 15, 115, and the like other than the piston rings 13 and 113.

Example 3

In this example, an example in which control methods of the tank integrated air compressor 100 respectively described in Examples 1 and 2 are combined will be described.

The configuration of the tank integrated air compressor 100 in this example is the same as the configuration described with reference to FIGS. 1 and 2 in Examples 1 and 2, so that the description thereof will be omitted.

In this example, a case where the tank integrated air compressor 100 has a function applicable to both a case of use in a cold region at an ambient temperature of 0° C. or lower and a case of use in a hot region at higher than 40° C. will be described.

That is, the tank integrated air compressor 100 according to this example has a function of carrying out control as shown in FIG. 5 or 7 described in Example 1 in a case of use in a cold region at an ambient temperature of 0° C. or lower and carrying out control as shown in FIG. 8 described in Example 2 in a case of use in a hot region at higher than 40° C.

Figure 10:
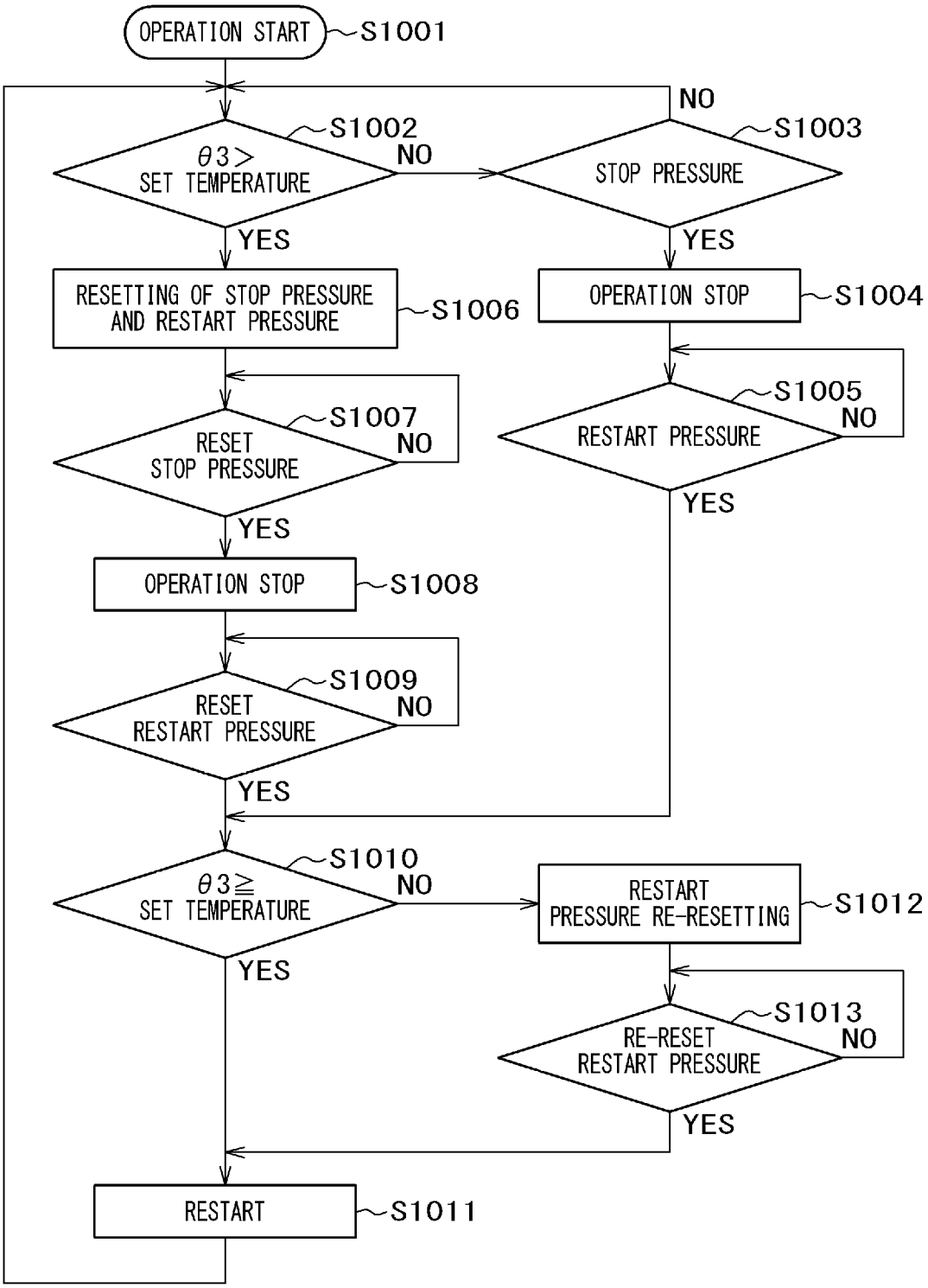
FIG. 10 is a flowchart showing a flow of operation control of the reciprocating compressor according to Example 3 of the present invention.

A process flow (flow) of the operation control of the tank integrated air compressor 100 according to this example described above will be described with reference to FIG. 10.

First, an operation is started by starting the motor 6 of the compressor body 1 via the control set 30 using input means such as a switch (not illustrated) (S1001). Next, it is determined whether or not the temperature θ3 of the cylinder 18 detected by the temperature detecting means 32 attached to the cylinder 18 exceeds a temperature set in advance (first set temperature) (S1002). In a case where the temperature θ3 of the cylinder 18 detected by the temperature detecting means 32 does not exceed the first set temperature (in a case of NO in S1002), the pressure of the air in the storage tank 24 is detected by the pressure sensor 31, and it is checked whether or not the internal pressure of the storage tank 24 has reached stop pressure: 304 set in advance (S903).

In a case where the internal pressure of the storage tank 24 has not yet reached stop pressure: 304 set in advance (in a case of NO in S1003), the process returns to S1002, and monitoring of the temperature θ3 of the cylinder 18 is continued in a state in which the operation of the compressor body 1 is continued.

On the other hand, in a case where the internal pressure of the storage tank 24 has reached stop pressure: 304 set in advance (in a case of YES in S1003), the operation of the compressor body 1 is stopped by stopping the driving of the motor 6 of the compressor body 1 (S1004), and it is monitored whether or not the internal pressure of the storage tank 24 has reached restart pressure: 304 set in advance (S1005). In a case where the internal pressure of the storage tank 24 has not reached restart pressure: 304 set in advance (in a case of NO in S1005), monitoring of the internal pressure of the storage tank 24 is continued in a state in which the operation of the compressor body 1 is stopped.

On the other hand, in a case where the internal pressure of the storage tank 24 has reached restart pressure: 304 set in advance (in a case of YES in S1005), the process proceeds to S1010, which will be described later.

In addition, in a case where the temperature θ3 of the cylinder 18 detected by the temperature detecting means 32 exceeds the first set temperature (in a case of YES in S1002), the stop pressure and the restart pressure are reset as described with reference to FIG. 8 (S1006) in Example 2, and it is monitored whether or not the internal pressure of the storage tank 24 has reached the reset stop pressure (S1007). In a case where the internal pressure of the storage tank 24 has not reached the reset stop pressure (in a case of NO in S1007), monitoring of the internal pressure of the storage tank 24 is continued in a state where the operation of the compressor body 1 is continued.

On the other hand, in a case where the internal pressure of the storage tank 24 has reached the reset stop pressure (in a case of YES in S1007), the operation of the compressor body is stopped by stopping the driving of the motor 6 of the compressor body 1 (S1008), and it is monitored whether or not the internal pressure of the storage tank 24 has reached the reset restart pressure (S1009). In a case where the internal pressure of the storage tank 24 has not reached the reset restart pressure (in a case of NO in S1009), monitoring of the internal pressure of the storage tank 24 is continued in a state in which the operation of the compressor body 1 is stopped.

On the other hand, in a case where the internal pressure of the storage tank 24 has reached the restart pressure reset in advance (in a case of YES in S1009), it is checked whether or not the temperature (θ3) of the outer wall surface of the cylinder 18 detected by the temperature detecting means 34 is equal to or higher than a prescribed value (second set temperature) set in advance (S1010), and in a case where the temperature (θ3) of the outer wall surface of the cylinder 18 is equal to or higher than the second set temperature (in a case of YES in S1010), the operation is resumed by restarting the motor 6 of the compressor body 1 (S1011), and the process returns to S1002. The temperature of the cylinder is checked.

On the other hand, in a case where the temperature (θ3) of the outer wall surface of the cylinder 18 has not reached the second set temperature (in a case of NO in S1010), the temperature (θ3) of the outer wall surface set in advance is reset to a restart pressure in a case where the second set temperature is not reached (S1012), it is checked whether or not the internal pressure of the storage tank 24 monitored by the pressure sensor 31 has reached the reset restart pressure (S1013). In a case where the internal pressure of the storage tank 24 has not reached the reset restart pressure (in a case of NO in S1013), monitoring of the internal pressure of the storage tank 24 is continued.

In a case where the internal pressure of the storage tank 24 has reached the reset restart pressure (in a case of YES in S1013), the process proceeds to S1011 and the operation is resumed by restarting the motor 6 of the compressor body 1.

Even in this example, as described in Example 2, even in a case where the temperature (θ3) of the outer wall surface exceeds the first set temperature at the time of the start of the operation or during the operation (in a case of YES in S1002) and control is carried out according to the flow from S1007 to S1011 on the basis of the stop pressure and the restart pressure reset in S1006, in a case where the temperature (θ3) of the outer wall surface becomes equal to or lower than the first set temperature, NO is determined in S1002, and as in the case of Example 2, it is determined that the stop pressure set in advance is reached (S1003). In a case where the stop pressure set in advance is reached (YES in S1003), stopping of the operation is carried out. In addition, in a case where it is determined whether or not the restart pressure set in advance is reached (S1005) and the restart pressure set in advance is reached (YES in S1005), the process proceeds to the subsequent step S1010.

In steps subsequent to S1010, as described in Example 1, even in a case where the temperature (θ3) of the outer wall surface of the cylinder 18 has not reached the prescribed value (second set temperature) (in a case of NO in S1010), the restart pressure is re-reset in S1012, and restart is carried out in S1011 in a state in which the re-reset restart pressure is reached, when steps from S1002 to S1010 proceed again in a subsequent cycle, in a case where it is determined that the temperature (θ3) of the outer wall surface of the cylinder 18 has reached the prescribed value (second set temperature) (in a case of YES in S1010) in S1010, restart is carried out when the restart pressure set in S1006 or the preset restart pressure used for the determination in S1005 other than the restart pressure re-reset previously in S1012 is reached (S1011).

As described in the examples, instead of the temperature detecting means 34 provided on the outer wall surface of the cylinder 18, a method for estimating the temperature of the cylinder 18 using the values of existing temperature detecting means 32 and 33 may also be provided.

According to this example, in a case where the product is used at a high temperature or a low temperature outside the use temperature range, even when the cylinder temperature increases or decreases, acceleration of wear on the sliding surface of the cylinder can be prevented and shortening of the life of the component can be prevented, so that it is possible to prevent shortening of the maintenance cycle or deterioration of performance.

REFERENCE SIGNS LIST

1 Compressor body
2 Stator
3, 4 Bearing
5 Bearing housing
6 Motor
6A Shaft
10 Cooling fan
13, 113 Piston ring
14, 114 Connecting rod set
16, 116 Eccentric
18, 118 Cylinder
20, 120 Air valve
21, 121 Cylinder head
24, 25 Storage tank
26 Cover
31 Pressure sensor
32, 33, 34 Temperature detecting means
100 Tank integrated air compressor

The invention claimed is:

1. A reciprocating compressor comprising:
a compressor body in which a piston reciprocates in a cylinder to compress a fluid;
a motor which drives the compressor body;
a controller which controls the compressor body;
a tank which stores the fluid compressed in the compressor body; and
a temperature sensor attached to the reciprocating compressor,
wherein the controller controls the compressor body to start the compressor body when a pressure of the fluid in the tank becomes equal to or lower than a start pressure, and stop the compressor body when the pressure of the fluid becomes equal to or higher than a stop pressure, and
the controller sets, of at least one of the start pressure and the stop pressure, a pressure applied in a case where a measurement temperature of the temperature sensor is outside a predetermined temperature range to be lower than a pressure applied in a case where the measurement temperature of the temperature sensor is within the predetermined temperature range, and
wherein, in a case in which the measurement temperature of the temperature sensor is less than a first predetermined value, the controller decreases only the start pressure of the compressor body, and, in a case in which the measurement temperature of the temperature sensor is greater than a second predetermined value, the controller decreases the start pressure and the stop pressure.

2. The reciprocating compressor according to claim 1,
wherein the measurement temperature of the temperature sensor is obtained by directly or indirectly measuring a temperature of the fluid discharged from the cylinder.

3. The reciprocating compressor according to claim 2,
wherein the temperature sensor is attached to any one of the cylinder, the compressor body, the motor, or the controller.

4. The reciprocating compressor according to claim 1,
wherein the controller sets, as the measurement temperature by the temperature sensor deviates from the predetermined temperature range set in advance, at least one pressure of the start pressure and the stop pressure which are applied to be decreased in a plurality of stages.

5. The reciprocating compressor according to claim 1,
wherein the controller sets the stop pressure applied in a case where the measurement temperature by the temperature sensor is higher than a predetermined upper limit temperature set in advance to be lower than the stop pressure applied in a case where the measurement temperature is within the predetermined temperature range.

6. The reciprocating compressor according to claim 5,
wherein the controller sets the start pressure applied in the case where the measurement temperature by the temperature sensor is higher than the predetermined upper limit temperature set in advance to be lower than the start pressure applied in the case where the measurement temperature is within the predetermined temperature range.

7. The reciprocating compressor according to claim 1, further comprising:

a notifier which notifies, in a case where the measurement temperature by the temperature sensor deviates from the predetermined temperature range set in advance, deviation from the predetermined temperature range.

8. A control method for a reciprocating compressor comprising:

driving a piston using a motor so as to cause the piston to reciprocate in a cylinder and compress a fluid;

storing the compressed fluid in a tank;

stopping the motor when a pressure of the compressed fluid stored in the tank becomes higher than a stop pressure set in advance; and starting the motor when the pressure of the compressed fluid stored in the tank becomes lower than a start pressure set in advance and storing the fluid compressed in the cylinder in the tank, wherein, in a case where a measurement temperature by a temperature sensor attached to the reciprocating compressor deviates from a temperature range set in advance, control of starting or stopping of the motor is carried out by decreasing at least one of the start pressure and the stop pressure, and wherein, in a case in which the measurement temperature of the temperature sensor is less than a first predetermined value, only the start pressure of the compressor body is decreased, and, in a case in which the measurement temperature of the temperature sensor is greater than a second predetermined value, the start pressure and the stop pressure are decreased.

9. The control method for a reciprocating compressor according to claim 8, wherein, in a case where the measurement temperature is within the temperature range set in advance, control of starting or stopping of the motor is carried out by increasing the lowered start pressure or stop pressure.

10. The control method for a reciprocating compressor according to claim 8, wherein the measurement temperature is obtained by directly or indirectly measuring a temperature of the fluid discharged from the cylinder using the temperature sensor.

11. The control method for a reciprocating compressor according to claim 10, wherein, as the measurement temperature, a temperature of the cylinder, a reciprocating compressor body, the motor, or a controller which controls starting or stopping of the motor measured by the temperature sensor is used.

12. The control method for a reciprocating compressor according to claim 8, wherein, as the measurement temperature deviates from a predetermined temperature range, at least one pressure of the start pressure and the stop pressure is decreased in a plurality of stages.

13. The control method for a reciprocating compressor according to claim 8, wherein the stop pressure applied in a case where the measurement temperature is higher than a predetermined upper limit temperature set in advance is set to be lower than the stop pressure applied in a case where the measurement temperature is within the predetermined temperature range.

14. The control method for a reciprocating compressor according to claim 13, wherein the start pressure applied in the case where the measurement temperature is higher than the predetermined upper limit temperature is set to be lower than the start pressure applied in the case where the measurement temperature is within the predetermined temperature range.

15. The control method for a reciprocating compressor according to claim 8, further comprising:

notifying, in a case where the measurement temperature deviates from the predetermined temperature range set in advance, deviation from the predetermined temperature range.

* * * * *